United States Patent [19]

Boe et al.

[11] 4,119,023

[45] Oct. 10, 1978

[54] PORTABLE PALLET STRAPPING DEVICE

[75] Inventors: Thomas Jerald Boe; Charles M. Fell; William Leon Jenkins, all of Naples, Fla.

[73] Assignee: A. Duda and Sons, Oviedo, Fla.

[21] Appl. No.: 814,729

[22] Filed: Jul. 11, 1977

[51] Int. Cl.[2] ..... B65B 13/18

[52] U.S. Cl. ..... 100/2; 100/8; 100/24

[58] Field of Search ..... 100/2, 1, 8, 17, 24, 100/25; 53/198 R

[56] References Cited

U.S. PATENT DOCUMENTS

| | | | |
|---|---|---|---|
| 2,780,986 | 2/1957 | Ritenour | 100/25 |
| 3,135,192 | 6/1964 | Derrickson | 100/8 |
| 3,152,539 | 10/1964 | Sorensen | 100/8 |
| 3,263,599 | 8/1966 | Dickens | 100/2 |

*Primary Examiner*—Billy J. Wilhite

*Attorney, Agent, or Firm*—Julian C. Renfro

[57] ABSTRACT

A threader device designed to simplify the threading of strapping tapes around and under a load to be strapped to a pallet or other load supporting device having a pair of apertures extending substantially horizontally through its base, with the threader device involving a framework having a pair of substantially parallel, elongate threader bars extending outwardly from its base for a distance sufficient to pass through the load supporting device. The threader bars are disposed slightly above ground level and spaced apart a distance consistent with the spacing of the apertures of the load supporting device. Tape dispensing means are carried on the framework, and arranged to dispense a pair of strapping tapes. The threader bars each have tape securing means on their outer ends, such that the ends of a pair of strapping tapes from the tape dispensing means can be removably secured to respective ones of the tape securing means. Therefore, upon the threader bars being caused to protrude through the apertures of a load supporting device, the ends of the strapping tapes are made available to the operator on the side of the load remote from the framework, so that he can easily detach the ends of the strapping tapes from the tape securing means, and then complete the encompassing of the load with the strapping tapes. For convenience of the operator, we preferably dispense the strapping tapes from the outer ends of a pair of tape supporting arms located a distance above the threader bars, with this arrangement simplifying the task of the operator in closing the tape loops around the load carried by the load supporting device.

10 Claims, 7 Drawing Figures

PORTABLE PALLET STRAPPING DEVICE

BACKGROUND OF THE INVENTION

In recent years the use of certain devices and techniques for strapping boxes of produce or the like has become increasingly popular. The strapping can be accomplished rapidly and effectively in many ways, including utilization in an assembly line fashion. Not only does this make produce handling more efficient, and loading able to be accomplished faster, but also a number of advantages are realized by the recipient.

When a number of boxes are to be secured to by strapping tapes to a pallet, this has heretofore dictated the use of very complex and costly machines that are expensive to maintain, and which require much attention in their use. It is to obviate the need for such expensive machines that the present novel tape threader was designed.

SUMMARY OF THE INVENTION

A preferred embodiment of a portable strapping device in accordance with this invention involves a pair of generally parallel, elongate threader bars mounted on a lower portion of a movable frame, which threader bars are spaced apart a distance consistent with the spacing of the apertures in a pallet or other load supporting device. Carried in a main portion of the frame are tape dispensing means serving to dispense in the typical instance, a pair of industrial strapping tapes, typically of plastic. For convenience of the operator, we typically dispense the tapes from the outer ends of respective tape supporting arms mounted high on the frame, generally parallel to the threader bars. The strapping tape extending downwardly from the end of each arm is then releasably attached to securing means located on the outer end of the respective threader bar. A roller is provided at the end of each arm such that more of the strapping tapes can be readily pulled from the tape dispensing means at such time as boxes or any other load is to be strapped to a pallet. To insure ready availability of the tapes at the ends of the tape supporting arms, we typically use rollers at the outer ends of the arms that permit the movement of tape in only the dispensing direction.

Although the pallet or other load supporting device could be brought to the tape threading device, a threader device in accordance with a preferred embodiment of this invention is movably mounted such that it may be brought into contact with a stationary pallet that has been appropriately placed. When the pallet has been oriented with its apertures toward the threader bars, upon our threader device being brought toward the pallet, the threader bars enter the lower apertures thereof and extend through the pallet, with the ends emerging from the far side. It is then but a simple matter for the operator to disengage the end of each strapping tape from its securing means, pull it upwardly until it can be brought into touching contact with the tape descending from the respective overhanging arm, with a handheld machine such as distributed by FMC then being utilized for tightening the tape so as to bind the boxes to the pallet with a desirable amount of tension. The handheld tool functions to secure the two tape portions together, such as by a metal clip, and thereafter to cut the tape supplied from the tape dispenser. This operation is well known in the art, and is not of particular consequence to the present invention. The use of our threader device thus makes it possible to strap boxes to a pallet in a much more rapid and economical manner than was heretofore possible.

It is therefore a primary object of our invention to provide a tape threading device of simple and inexpensive construction, making it easily possible to rapidly secure boxes or other items to a pallet.

It is another object of our invention to provide a movable threader device of low cost that can be brought into operative contact with a standard pallet, with our device utilizing threader bars that extend through the apertures of the pallet to thread the ends of strapping tapes such that they can be readily grasped by the operator on the far side of the load, and used for securing to other parts of the same tapes, thus to form closed loops about the load.

BRIEF DESCRIPTION OF THE DRAWINGS

FIG. 1 is a perspective view of our novel threader device for threading strapping tapes around and under a load to be strapped to a pallet or the like;

DETAILED DESCRIPTION

Figure 1:
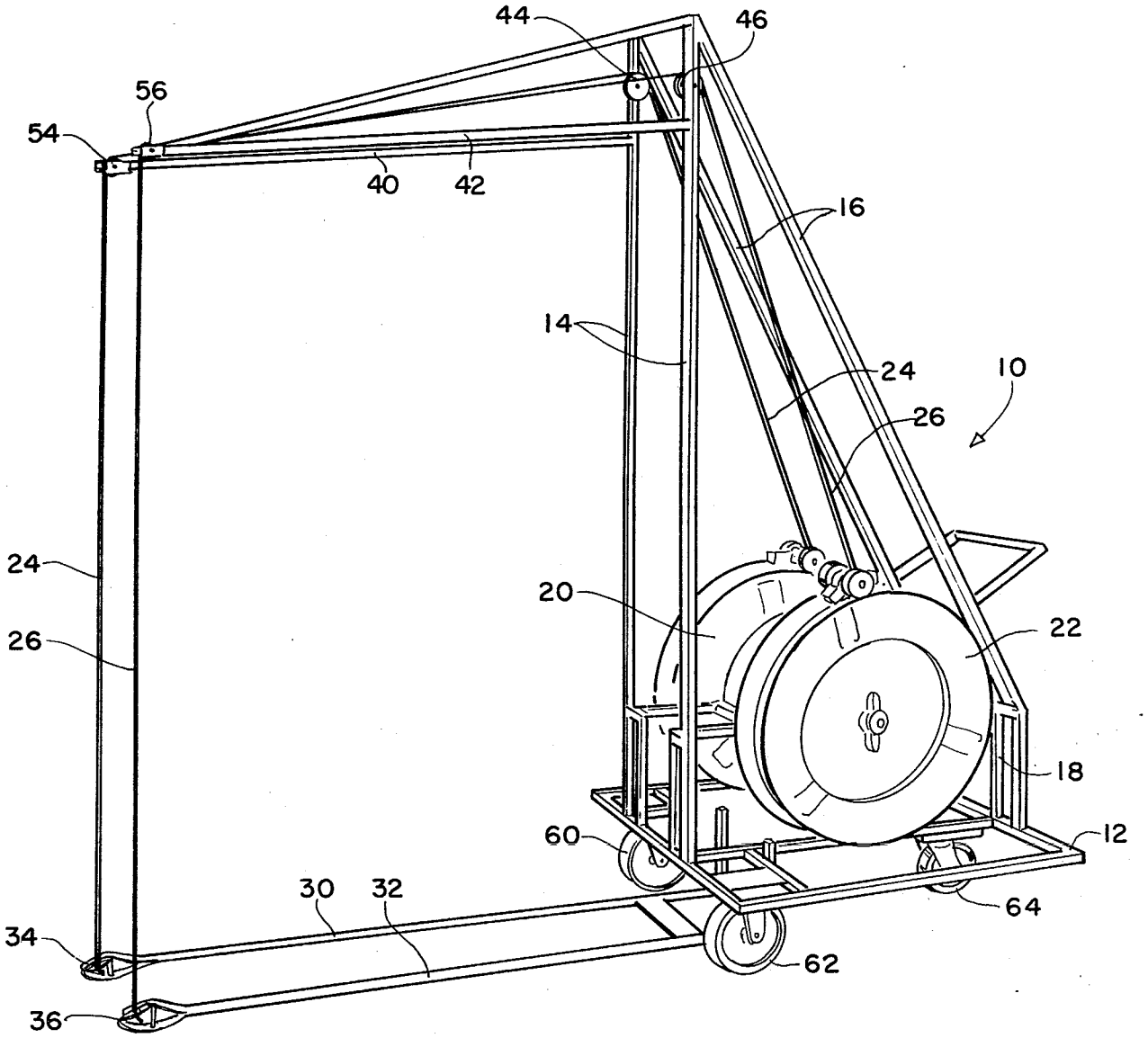

Turning to FIG. 1, it is there to be seen that we have provided a novel tape threading device 10 designed to utilize conventional industrial strapping tape in connection with the strapping of one or more boxes, such as of produce, to a load supporting device, such as a pallet. The threader device is principally made up of a frame 12 of steel or aluminum components, and it may have a pair of vertical members 14 in its forward portion, a pair of generally sloped structural members 16 in its rear portion, and a base portion 18. A pair of tape dispensers 20 and 22 serve as the tape dispensing means in this preferred embodiment, with these dispensers being mounted in the base portion 18. Each dispenser contains a rotatable drum (not shown) upon which several hundred feet of industrial strapping tape can be carried. The strapping tape is preferably of polypropylene or polyester, and is available in a number of sizes, such as $\frac{1}{4} \times 0.015$ inch $\frac{3}{8} \times 0.015$ inch, $\frac{3}{8} \times 0.020$ inch, $\frac{1}{2} \times 0.020$ inch, and the like. These tapes are quite strong and are utilized in connection with commercially available tensioning devices in order that the boxes or other components can be held tightly to the pallet during shipment. By way of example, the dispensers 20 and 22 may each be Signode Dymax Strap Dispensers, Model D0-3D, and the handheld tensioning device can for example be of a type marketed by FMC, such as the AVTS-476 Tensioner/Sealer. Although we can close the loops of tape about the load by sealing, we prefer to use metal closures, such as clips, for securing the tape ends together.

Mounted on the frame 12 in accordance with this invention are a pair of threader bars 30 and 32, which are generally parallel, and of elongate configuration. The threader bars are preferably of steel, having say a cross-section of 1 by ¾ inch, and extend outwardly from the base portion of the frame for a greater length than the dimension of a standard pallet. For example, the bars 30 and 32 may be 54 inches long, and are spaced apart a distance such that they may extend through separate apertures of a conventional wooden pallet or the like. Importantly, tape securing means 34 is located at the outermost end of threader bar 30, and tape securing means 36 is located at the outer end of threader bar 32, for a purpose that will be more apparent as the description proceeds.

Strapping tapes 24 and 26 dispensed from the tape dispensers 20 and 22, respectively, are to be made available to the operator on the far side of the load, as well as above the load, in order that he can close the loops of tape about the load. Although we could make the uncut tape loop available at another location, we prefer to feed the tapes upwardly from the dispensers, and make them available at the outer ends of a pair of overhanging arms 40 and 42, which are parallel to each other as well as generally parallel to the threader bars 30 and 32. These arms are held approximately in horizontal positions by suitable frame members. The tapes 24 and 26 extend upwardly through the framework, respectively pass over rollers 44 and 46 located at the inner ends of the arms 40 and 42, and then over rollers 54 and 56 located on the outer ends of the arms.

As indicated in FIG. 1, when the tape threading device is about to be placed in action, the tapes 24 and 26 extend downwardly, with the tape 24 extending downwardly from the roller 54 being engaged by the releasable securing means 34 located at the outermost end of the threader bar 30, and with the tape 26 extending downwardly from the roller 56 being engaged by the releasable tape securing means 36 at the outermost end of threader bar 32. In this position the tape threader 10 is ready to be utilized in threading strapping tape through the underside of a pallet or other type of load-supporting device, in order that such tape may thereafter be used for securing boxes or other items thereon.

Figure 2:
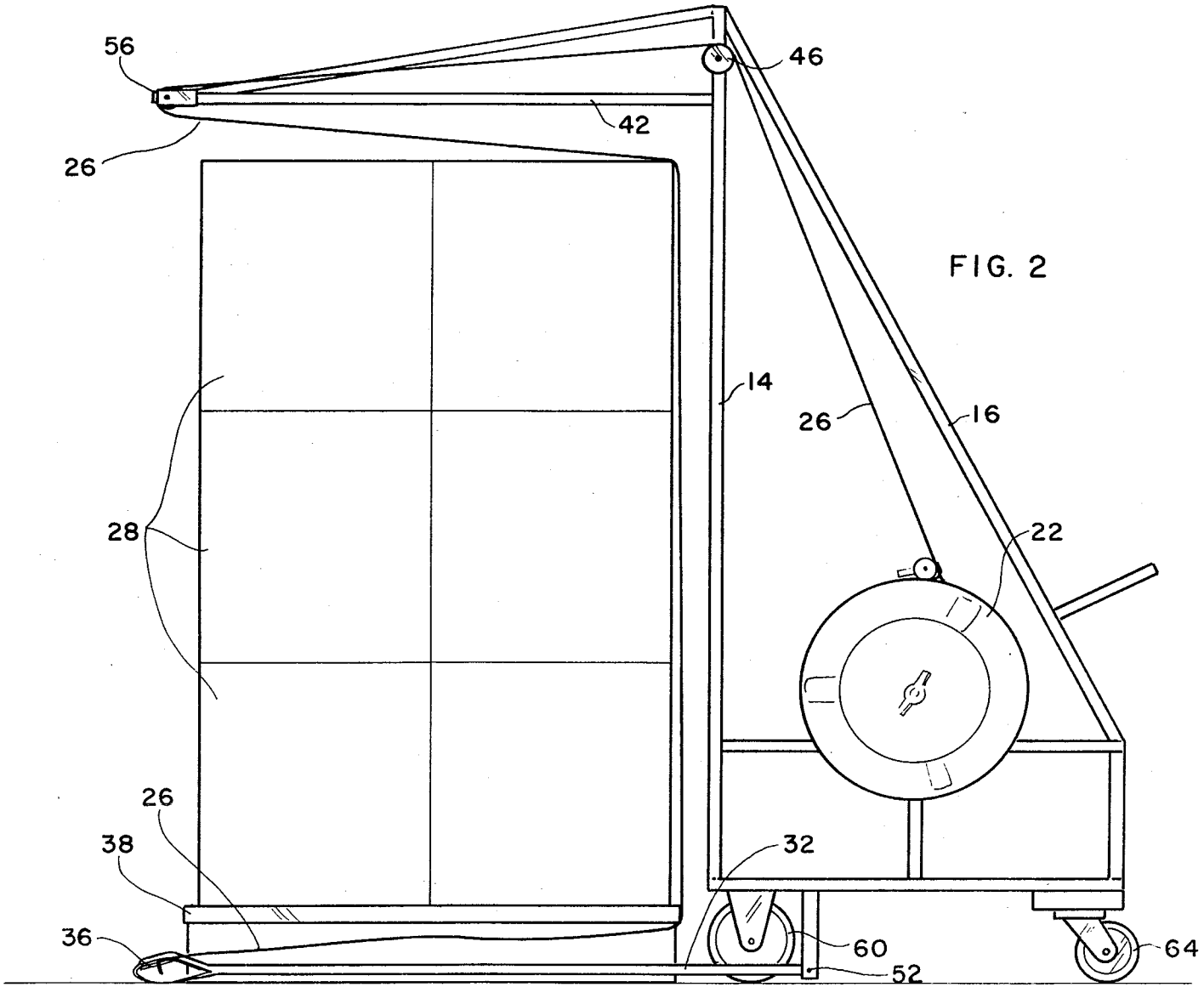
FIG. 2 is a side elevational view of our threader device, showing the typical relationship of the device to boxes to be strapped to a pallet.

In FIG. 2, the tape threader has been brought into contact with a conventional pallet 38, with the threader bars 30 and 32 extending through respective apertures located between the upper and lower surfaces of the pallet. The threader bars obviously must be of a length such that their outer ends emerge from the other side of the pallet, and the inner ends of the bars are preferably connected to the base 18 of the frame in such a manner that the bars are somewhat rotatable. By using a pin joint 52 in the manner shown in FIG. 2, the threader bar 32 is sufficiently rotatable that it can rise and fall where necessary to enter the aperture of a pallet. The forwardmost ends of both threader bars are of course rounded in order to simplify insertion of the bars through the apertures of the pallet.

As will be noted in FIG. 2, which is a cross-sectional view taken adjacent threader bar 32, upon the frame 12 being rolled or otherwise moved into operative contact with the pallet 38, the passing of the threader bars through apertures of the pallet causes a folding back of the strapping tapes along the respective threader bars, with the tapes thereafter extending upwardly in the vicinity of the vertical frame members 14. As will be noted from FIG. 2, the tape 26 forms a large loop conforming to the load of boxes 28 carried by the pallet, with the tape drums of the dispenser 22 (and 20) rotating to a sufficient extent during the approach of the frame to the pallet as will permit the dispensing of the additional tape needed. Suitable braking means provided by the manufacturer on the dispensers 20 and 22 prevent too much tape being dispensed during this phase. Sets of rollers 44 and 46, and 54 and 56 roll easily in the direction appropriate for the dispensing of this additional footage of tape from the reels 20 and 22.

As viewed in FIG. 2, the operator standing adjacent the pallet can now reach down and take the tape end from tape retaining device 36 and then bring this end up into contact with a portion of the loop of tape 26 extending downwardly from roller 56. With these two tape portions in his hands, the operator can then easily apply a handheld machine, such as of a type distributed by FMC, which is used to first bring about a tensioning of the loop of tape, and thereafter securing the tape portions together. The preferred type of handheld machine is operated by suitable manipulation of a handle by the operator, with this action serving to bring the tape to an appropriate tension, such as 90 pounds. We are obviously not to be limited to a hand powered tensioning tool, for one powered by say compressed air may be used if desired.

After suitable tensioning of a given tape, the loop around the load is then finalized by the use of a clip or buckle, although in some instances sealing by heat or pressure may be preferred. The portion of the tape leading back to the dispenser 22 is then automatically cut at the appropriate location. Loss of availability of the tape end to the operator is prevented by utilizing rollers 54 and 56 that turn easily only in the tape dispensing direction, and do not permit the portions of tape extending along the upper arms 40 and 42 to move in the direction of the dispenser 22 subsequent to the cutting of the tape.

In a similar manner, the operator grasps the tape 24 retained by the member 34 (not shown in FIG. 2), and then brings that tape and upwardly into contact with the tape passing downwardly from the roller 54. The end of the tape 24 is then secured, preferably by a clip, to the appropriate portion of the loop of tape passing downwardly from the roller 54, after sufficient tension has of course been applied about the boxes 28 by the handheld machine. As before, cutting of the tape adjacent the closure is then brought about. As should now be apparent, boxes of produce, or of a wide variety of other items, may thus be effectively and inexpensively secured to a pallet in a rapid manner.

The tape threading device is then rolled or otherwise moved away from this pallet and the boxes carried threby, and after re-threading of the ends of the tapes 24 and 26 into the tape retaining means 34 and 36, the tape threader is ready to be used with another pallet. As is obvious, our tape threading device may be confined to operation in a particular location, but in a preferred embodiment of our invention, a pair of wheels 60 and 62 are used in the front, and a caster type wheel 64 is located on a rear portion of the frame 12, this latter wheel permitting the rear of the frame to be swung in a wide arc, thus enabling it to be rolled away from the first pallet, and into operative contact with the next pallet, which may be located close by. On the other hand, the preferred embodiment of our tape threader is sufficiently light and mobile as to enable it to be rolled to whatever location in a plant it may again be desired to be utilized for strapping components to a pallet.

Figure 3:
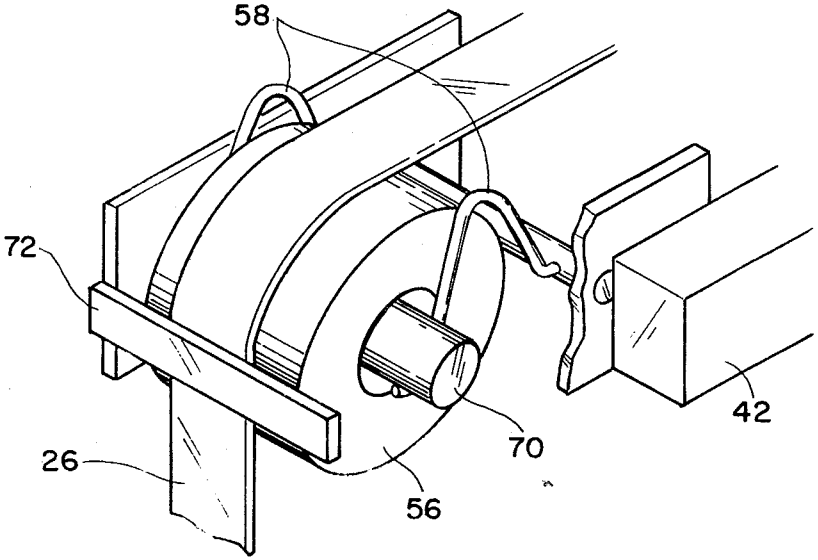
FIG. 3 is a greatly enlarged view of a unidirectional roller of the type utilized on the end of each tape supporting arm.

FIG. 3 illustrates the support arrangement for roller 56 located on the outer end of upper arm 42. Although this roller (and of course roller 54) can turn easily in the tape dispensing direction, because of the bias presented by springs 58, it will not rotate readily in the opposite direction, thus inhibiting movement of the respective tape in the wrong direction. The preferred arrangement involves the roller 56 having an oversize mounting hole, so that its movements about mounting pin 70 can be such as to enable the surface of roller 56 to contact the bar 72, in response to the spring bias. Pulling of the tape 26 by the operator serves to overcome the bias of springs 58, and permit a ready dispensing of tape, whereas a cessation of pull on the tape permits these springs to move the tape into firm contact with the bar 72, to effect a form of braking action.

Figure 4A:
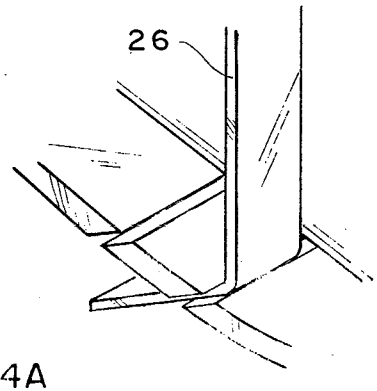
FIG. 4A is a fragmentary view to an even larger scale of the angled slot preferably used to prevent tape slippage in the tape securing means.
Figure 4:
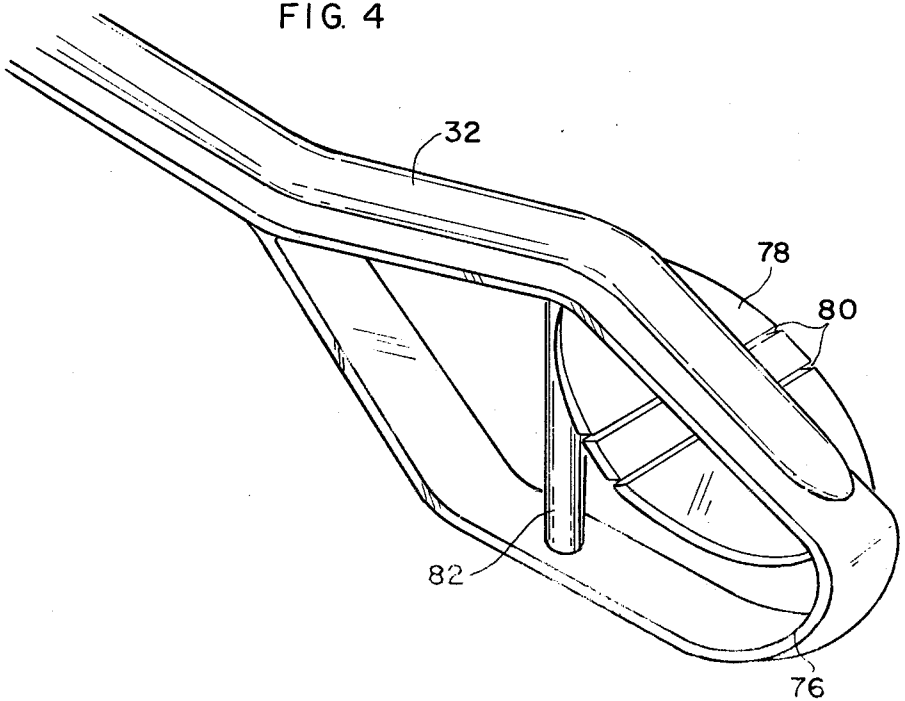
FIG. 4 is a greatly enlarged view of the tape securing means utilized on the outer end of each threader bar.

FIG. 4 reveals a preferred form of the tape securing mean used at the end of each of the threader bars. This means may take the form of a loop 76 created in the bar, on the inside of which loop is secured a steel plate 78. A post 82 assures the proper size of the loop being maintained. In plate 78 are created a plurality of diagonal saw cuts 80, with the angularity of the saw cuts being such as to tightly retain the tape, and to effectively resist a pulling out of the tape when the threading device is moved into operational contact with a pallet. Thereafter, when the operator wishes to close the loop of tape about the boxes or other load on the pallet, it is but a simple matter to withdraw the tape end from the end of the saw cut.

Figures 5, 5A:
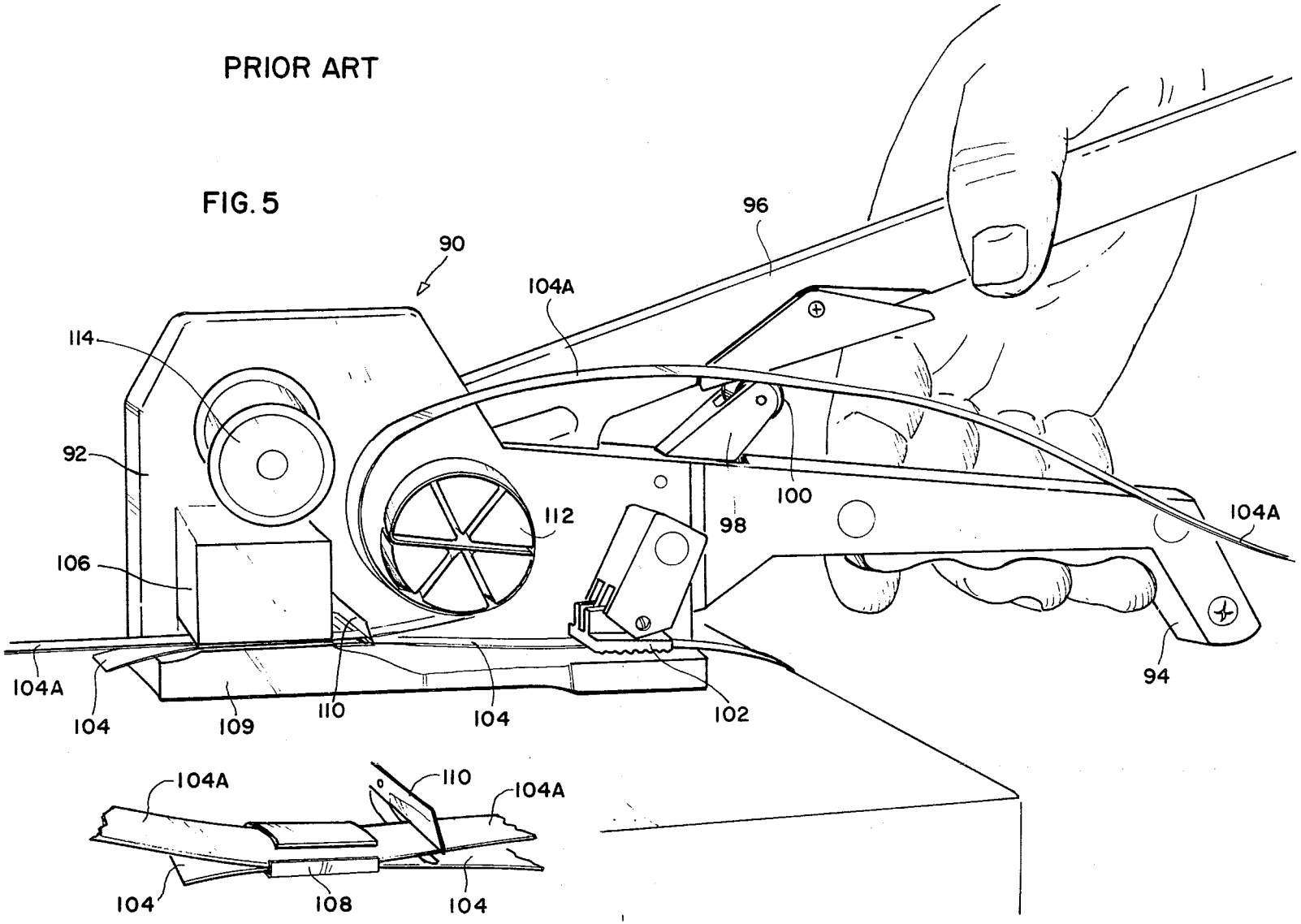
PRIOR ART FIG. 5
FIG. 5 is a side elevational view of a typical prior at handheld machine of the type that may be used for tensioning the strapping tape about a pallet upon which boxes are carried, and for thereafter securing the tape ends together; and FIG. **5*a*** is a fragmentary view of two tape portions shown passing through a metal clip of the type that is clinched by the handheld machine in order that the tape ends may be tightly secured together.

Turning now to FIG. 5, it will there be seen that we have illustrated a typical handheld device 90 in accordance with the prior art, with the device in this instance being a model PSTS-476 manufactured by FMC Corporation, with this manually-operated tool per se forming no part of this invention. The device 90 is principally made up of a housing portion 92, with which a lower handle 94 is integral, and a pivoted upper handle 96. Appropriate movement of the pivoted upper handle 96 with respect to the rest of the device brings about a number of different operative functions as will now be explained.

Upon the handles being squeezed in the manner illustrated in FIG. 5, an inside portion of the upper handle is brought into contact with a lever 98 pivotally disposed in the lower handle, on the outer end of which may be located on a roller 100. Initially, the depression of the lever 98 by movement of the upper handle in the direction of the lower handle causes a lifting of the tape-holding device 102 away from the tape anchoring position shown. The spring-biased holding device 102 is not employed to hold the tape 104 close to its cut end, for as shown in FIG. 5, the tape end 104 is caused to extend over to the area of the movable jaw 106, and extend through a metal clip 108 disposed between the jaw and the anvil member 109. Note FIG. 5*a*. Further motion of the upper handle 96 toward the fixed handle 94 causes an operation of the tape cutter 110, but this function is not involved until after the clip has been clinched, as will afterward be explained in greater detail.

After the strapping tape has been passed around the pallet and boxes, the uncut loop 104A is brought back into contact with the housing in the vicinity of the jaws, passing through the clip 108 in doing so, and also passing between the jaws of the cutter 110. The uncut loop 104A is then threaded through the rotatable notched wheel 112, with this end of course extending back to the tape dispenser, not shown in this figure.

Upon the handheld device being positioned properly with respect to the tape, the operator then proceeds to move the upper handle 96 in a series of upward ratchet-like movements, with each upward movement having the result of causing a commensurate rotation of the notched wheel 112. Because the strapping material leading back to the dispensing drum is threaded through a selected notch extending across the face of wheel 112, such rotation of the wheel eventually brings about the tensioning of the strapping tape about the pallet and boxes thereon. When the strapping tape has achieved the desired tightness, a button (not shown) on the end of the upper handle 96 is depressed, with this enabling subsequent upward movements of the upper handle to bring about the gradual closing of the movable jaw 106 against the clip as a result of movement of the member 114. Upon the clip being compressed quite tightly, this causes the two ends of the tape to be firmly held together, with any attempt to pull these ends apart being met with great resistance.

As is obvious, it is now desirable to cut the end of the tape leading back to the drum of material, and this is brought about by squeezing the handles 94 and 96 together. About the same time as the cutter 110 severs the non-taut tape portion, the tape holder 102 is automatically raised, and this enables the user to slide the machine laterally with respect to the now completed encircling strap. The tightly clinched metal clip is now able to be slid relatively easily out from between the jaw and the anvil, and the machine removed for subsequent use elsewhere.

It is important to note that this device is being described as merely exemplary of a handheld strapping device, and we obviously are not to be limited to the use of this particular machine, or even this same type of strapping device with our novel threader.

It should now be apparent that we have provided a novel, useful, and highly effective threader at but a fraction of the cost of the complex threading devices currently being marketed in the United States.

We claim:

1. A threader device designed to simplify the threading of strapping tapes around and under a load to be strapped to a pallet or other load-supporting device, said threader device comprising a framework, a pair of substantially parallel, elongate threader bars extending outwardly from the base of said framework, tape dispensing means carried on said framework, from which a pair of strapping tapes are disposed, and means for removably securing the end of a length of strapping tape to the outer end of each threader bar, such that when the threader bars are caused to protrude through the base of the load-supporting device, the ends of the strapping tapes are made available to the operator, so that he can then easily complete the encompassing of load with the strapping tapes.

2. The threader device as defined in claim 1 wherein tape supporting arms are located above said threader bars, with the strapping tapes being dispensed from the outer ends of said arms.

3. The threader device as defined in claim 2 wherein tape braking means are utilized at the outer end of each of said arms.

4. The threader device as defined in claim 1 wherein said framework is provided with wheels, enabling it to be rolled easily from place to place.

5. A threader device designed to simplify the threading of strapping tapes around and under a load to be strapped to a pallet or other load supporting device having a pair of apertures extending substantially horizontally through its base, said threader device comprising a framework, said framework having a pair of substantially parallel, elongate threader bars extending outwardly from its base for a distance sufficient to pass through the load supporting device, said threader bars being disposed at a location slightly above ground level and being spaced apart a distance consistent with the spacing of the apertures of the load supporting device, tape dispensing means carried on said framework and arranged to dispense a pair of strapping tapes, said threader bars each having tape securing means on their outer ends, such that the ends of a pair of strapping tapes from said tape dispensing means can be removably secured to respective ones of said tape securing means, whereby when said threader bars are caused to protrude through the apertures of a load supporting device, the ends of the strapping tapes are made available to the operator on the side of the load remote from said framework, so that he can easily detach the ends of the tapes from the tape securing means, and then complete the encompassing of the load with the strapping tapes.

6. The device as defined in claim 5 wherein tape supporting arms substantially parallel to said threader bars are located a distance above said threader bars, with a strapping tape being dispensed from the outer end of each of said arms, with such tape ends being movable by the operator into contact with respective ones of said tape securing means, each of said strapping tape ends being attachable to the respective tape securing means preparatory to use of the threader device.

7. The threader device as defined in claim 6 wherein tape braking means are utilized at the outer end of each of said arms.

8. The threader device as defined in claim 5 wherein said framework is provided with wheels, enabling it to be rolled easily from place to place.

9. The method of threading strapping tapes through the apertures of a pallet so that a load can be readily strapped to the pallet, by the use of a threader device having tape dispensing means thereon, and a pair of threader bars extending outwardly from the base of the device, comprising the steps of securing the end of a strapping tape to the end of each threader bar, moving the threader device into contact with a loaded pallet, so as to cause the threader bars to extend through the apertures of the pallet, and the tapes to lie back along the threader bars, removing the tape ends from the protruding ends of the threader bars, and bringing same into contact with respective loop portions of the tapes, thus to form two loops around the load, applying a tensioning tool to each tape to bring about a desirable amount of tension therein, securing each tape end fast to the loop of the respective tape, and thereafter cutting away the untensioned portion of each tape.

10. The method as defined in claim 9 including the step of re-attaching the cut tape ends to the ends of the threader bars, preparatory to use with the next pallet.

* * * * *